United States Patent [19]

Itoh et al.

[11] Patent Number: 4,772,537

[45] Date of Patent: Sep. 20, 1988

[54] SILVER HALIDE PHOTOGRAPHIC MATERIALS CONTAINING A PHOTOGRAPHIC REAGENT PRECURSOR

[75] Inventors: Isamu Itoh; Mitsunori Ono, both of Minami-ashigara, Japan

[73] Assignee: Fuji Photo Film Co., Ltd., Kanagawa, Japan

[21] Appl. No.: 908,689

[22] Filed: Sep. 18, 1986

[30] Foreign Application Priority Data

Sep. 18, 1985 [JP] Japan ..... 60-204450

[51] Int. Cl.[4] ..... G03C 1/40; G03C 5/54; G03C 1/08

[52] U.S. Cl. ..... 430/219; 430/218; 430/223; 430/443; 430/445; 430/446; 430/566; 430/955; 430/957; 430/958; 430/959; 430/960

[58] Field of Search ..... 430/218, 219, 223, 445, 430/446, 566, 955, 957, 958, 959, 960, 443

[56] References Cited

U.S. PATENT DOCUMENTS

| | | | |
|---|---|---|---|
| 3,615,617 | 10/1971 | Bardoff et al. | 96/109 |
| 3,674,478 | 7/1972 | Grasshoff et al | 96/3 |
| 3,791,830 | 2/1974 | Abele | 96/76 R |
| 4,009,029 | 2/1977 | Hammond et al | 96/3 |
| 4,248,962 | 2/1981 | Lau | 430/382 |
| 4,263,393 | 4/1981 | Chen | 430/218 |
| 4,310,612 | 1/1982 | Maberry et al. | 430/223 |
| 4,335,200 | 6/1982 | Ohashi et al. | 430/446 |
| 4,350,752 | 9/1982 | Reczek et al. | 430/219 |
| 4,363,865 | 12/1982 | Reczek et al. | 430/223 |
| 4,410,618 | 10/1983 | Vanmeter et al. | 430/219 |
| 4,416,977 | 11/1983 | Ohashi et al. | 430/446 |
| 4,420,554 | 12/1983 | Ohashi et al. | 430/446 |
| 4,500,636 | 2/1985 | Ono et al. | 430/566 |
| 4,618,563 | 10/1986 | Ono et al. | 430/219 |
| 4,629,683 | 12/1986 | Itoh et al. | 430/390 |

*Primary Examiner*—Paul R. Michl
*Assistant Examiner*—Patrick A. Doody
*Attorney, Agent, or Firm*—Birch, Stewart, Kolasch & Birch

[57] ABSTRACT

A silver halide photographic material which contains at least one blocked photographic reagent having in the molecule thereof at least one $$-S-\overset{|}{N}-C-$$

structure and capable of releasing a photogrpahically useful reagent by cleavage of the $$-S-\overset{|}{N}-$$

bond by a nucleophilic attack of a nucleophilic reagent on the structure and a subsequent intramolecular electron transfer reaction or an intramolecular nucleophilic reaction and which has at least one photosensitive silver halide emulsion layer. There is provided a photogrphic material which includes, in combination, a photographic reagent precursor capable of releasing a photographically useful reagent timely on photographic processing and a photosensitive silver halide emulsion layer.

23 Claims, No Drawings

SILVER HALIDE PHOTOGRAPHIC MATERIALS CONTAINING A PHOTOGRAPHIC REAGENT PRECURSOR

BACKGROUND OF THE INVENTION

1. Field of the Invention

The present invention relates to photographic materials which comprise, in combination, a precursor of a photographic reagent capable of releasing a photographically useful reagent timely on photographic processing and a silver halide emulsion layer.

2. Description of the Prior Art

When photographically useful reagents are added to a photographic material, several advantages are attained due to the mixture of the reagents, which are totally different from the use of photographic reagents contained in a processing solution. For example, (1) it is possible to use photographic reagents which are able to readily decompose with acids or alkalis or under oxidation or reduction conditions and which cannot withstand a processing bath for a long period of time, (2) the composition of a processing solution is simple and is easy to prepare, (3) it is possible to permit a necessary photographic reagent to react with good timing at the time of the processing, (4) it is possible to allow a necessary reagent to act on a necessary spot, i.e. a specific type of layer and/or its adjacent layer alone of a multilayer photographic material, and (5) the amount of a photographic reagent can be varied as a function of development with silver halide. However, if photographic reagents are added to a photographic material in the active form, they react with other ingredients of the photographic material during storage prior to the processing or decompose by the action of heat or oxygen. Thus, they cannot exhibit the performance as will be expected at the time of the processing.

One of the processes known in the art to solve the above problem is to block active groups of a photographic reagent into substantially inert groups in the photographic material. In other words, the photographic reagent is added to the photographic material as a precursor of a photographic reagent reacting only at the time of the developing process.

According to the above process, when the useful photographic reagent is, for example, a dye, functional groups which influence the spectral absorption of the dye are blocked and cause the spectral absorption to be shifted toward a side of a shorter or longer wavelength. Accordingly, if such a dye coexists in a silver halide emulsion layer having a desired light-sensitive spectral range, any lowering of the sensitivity due to a filler effect does not occur. When the useful photographic reagent is an antifoggant or a development restrainer, blocking of the active groups permits the desensitizing action due to absorption on the photosensitive silver halide or its formation of a silver salt during storage to be suppressed. At the same time the fogging is reduced without deteriorating the sensitivity, the fogging by excess development can be suppressed or the development can be stopped at any time required timely release of the photographic reagent during the developing process. When the useful photographic reagent is a developing agent, a developer aid, a development accelerator or a nucleating agent, various adverse photographic effects the formation of semiquinone or oxidants by oxidation with air during storage or formation of fogging nuclei during storage caused by injection of electrons into the silver halide can be prevented by the blocking of the active or adsorbing groups. As a result, stable photographic processing is ensured. Similarly, when the photographic reagent is a bleaching promotor or a bleaching and fixing promotor, blocking of the active groups permits the reaction with other ingredients during storage to be suppressed so that a required performance may be obtained at a required time by removing protecting groups at the time of the development.

As explained hereinabove, the precursors of photographic reagents are effective in producing a satisfactory performance of the photographic reagents. On the other hand, however, these precursors must satisfy very severe reciprocal requirements. The precursors must meet such a contradictory requirement that they are stable under conditions of storage and the blocking groups can be removed at a required time so as to rapidly and efficiently release the photographic reagent.

Several blocking techniques for photographic reagents are known in the art. For instance, Japanese Patent Publication No. 44805/72 describes the utilization of blocking groups such as acyl, sulfonyl and the like groups. In Japanese Patent Publication Nos. 39727/79, 9696/80 and 34927/80, blocking groups which can release a photographic reagent according to a so-called Michael reaction are utilized. Japanese Patent Publication No. 39727/79, and Japanese Patent Application (OPI) Nos. 135944/82, 135945/82, and 136640/82 describe the utilization of blocking groups capable of releasing photographic reagents accompanied by the formation of quinone methide or its analogous compounds by the electron transfer in the molecule. In Japanese Patent Application (OPI) No. 53330/80, there is described the utilization of an intramolecular ring closure reaction. Japanese Patent Application (OPI) Nos. 76541/82, 135949/82 and 179842/82 describe the utilization of cleavage of five-membered or six-membered ring compounds.

These known blocking techniques for photographic reagents are disadvantageous in that, when using stable precursors under storage conditions, the speed of releasing a photographic reagent at the time of the processing is so small that the precursors have to be subjected to a high alkali treatment at a pH over 12. Even though a satisfactory releasing speed is satisfied by the use of a processing solution having a pH of 9 to 12, precursors gradually decompose under storing conditions and lose their characteristic properties.

When a liquid developer having a high pH over 12 is used, the developer is susceptible to oxidation with air. Thus, the shelf stability of the developer becomes lower and corrosion of a developing bath is accelerated. In addition, because of the high skin irritativeness, it becomes difficult to handle. Furthermore, the photographic sensitivity and the stability of a formed image are difficult to maintain when using a liquid developer of a higher pH.

SUMMARY OF THE INVENTION

It is therefore an object of the present invention to provide a precursor of a photographic reagent which is completely stable under storage conditions of photographic materials and release the photographic reagent at a desired time during developing processing.

It is another object of the present invention to provide a precursor of a photographic reagent which is able to release the reagent, as desired, in a processing solution of a relatively lower pH range of from 9 to 12.

It is a further object of the present invention to provide a silver halide photographic material which comprises precursor of photographic reagents.

Other objects, features and advantages of the present invention will be appear more fully from the following description.

DETAILED DESCRIPTION OF THE INVENTION

The above-mentioned objects of the present invention can be achieved by a silver halide photographic material containing at least one photosensitive silver halide emulsion layer and comprising at least one kind of photographic reagent precursor represented by the following general formula:

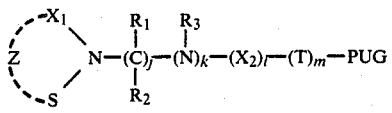

(I)

wherein $X_1$ represents a carbonyl group, a thiocarbonyl group, a sulfonyl group, a sulfinyl group or =N—R (wherein R represents a hydrogen atom or an organic substituent); $X_2$ represents an electrophilic center; Z represents a group of non-metallic atoms forming five- to seven-membered rings; PUG represents a photographically useful group; $R_1$ and $R_2$ independently represent a hydrogen atom or a substituent; $R_3$ represents an organic substituent; T represents a timing group; and J is an integer of from 0 to 3; k, l and m are independently 0 or 1, with the provision that when k is 1, l is 1 and when y is 0, k and l are 1.

The photographically useful groups represented by PUG in general formula (I) react as a photographic reagent by being released in the processing solution. Accordingly, the photographically useful groups may be those of usual photographic reagents bonded through a hetero atom (an atom other than carbon and not limited to that in a heterocyclic ring). Examples of the reagents includes antifoggants or development restrainers such as mercaptotetrazoles, mercaptotriazoles, mercaptopyrimidines, mercaptobenzimidazoles, mercaptothiadiazoles, benzotriazoles, imidazoles and the like; developing agents such as p-phenylenediamines, hydroquinones, p-aminophenols, and the like; auxiliary developing agents such as pyrazolidones; nucleating agents such as hydrazines, hydrazides and the like; solvents for silver halide such as sodium thiosulfate; bleach promoters such as aminoalkylthiols; or azo dyes and azomethine dyes. Photographic reagents which have the redox function capable of releasing the above-indicated photographic reagents as a function of development may also be used, including, for example, colorants for color diffusion transfer materials or DIR-hydroquinones.

The term timing group, T, of general formula (I) is known per se and means a group having a timing function that a time to a state capable of utilizing the group represented by PUG is properly delayed. More particularly, T has the function of permitting a given time to pass after the bond between $X_2$ and T has been cleft to form the $(T)_m$-PUG residue but before the bonding between $(T)_m$ and PUG is cleft. Accordingly, when $(T)_m$-PUG is diffusible, it will be possible to design a photographic material in which PUG is formed and works at a portion distant from a position where a precursor incorporated.

Particularly preferable timing groups employed in the photographic reagent precursor are represented by the following formulae wherein symbol * expresses the position at which the residue except PUG and the timing group are bonded, and symbol ** expresses the position at which PUG is bonded. The timing group may be the combination of the following two or more formulae:

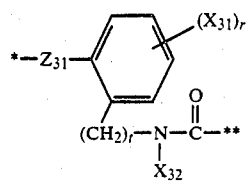

(T-1)

wherein $Z_{31}$ represents

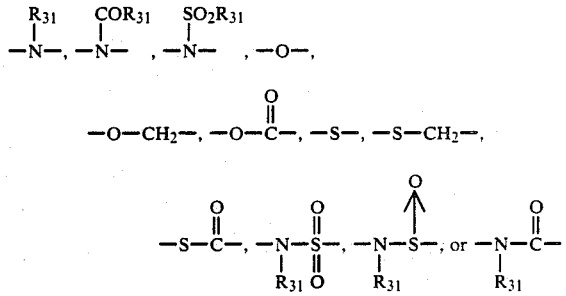

wherein $R_{31}$ is a hydrogen atom, an aliphatic, alicyclic, or aromatic hydrocarbon group, or a heterocyclic group; $X_{31}$ represents an aliphatic, alicyclic or aromatic hydrocarbon group or a heterocyclic group,

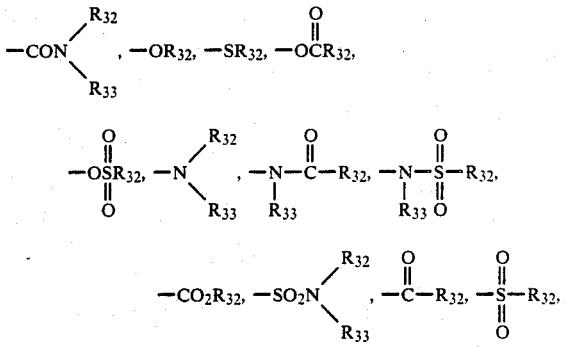

a cyano group, halogen atoms (e.g., fluorine, chlorine, bromine, and iodine) or a nitro group wherein $R_{32}$ and $R_{33}$ may be or may not be identical and express the same groups as described for $R_{31}$; $X_{32}$ represents the same groups as described for $R_{31}$; r represents an integer of from 0 to the total number of hydrogen atoms in the ring which are able to be substituted (in formula (T-1) r represents an integer of from 0 to 4), and when r is 2 or more, the substituent represented by $X_{31}$ may be or may not be identical, and when r is 2 or more, $X_{31}$ may link to each other to form a ring; and t represents 0, 1 or 2.

The groups represented by formula (T-1) are, for example, described in U.S. Pat. No. 4,248,962:

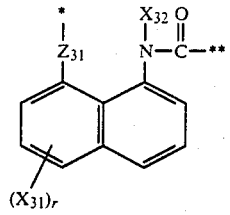

(T-2)

wherein $Z_{31}$, $X_{31}$, $X_{32}$ and r denote the same meanings as those defined for formula (T-1):

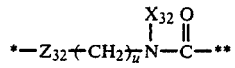

(T-3)

wherein $Z_{32}$ represents

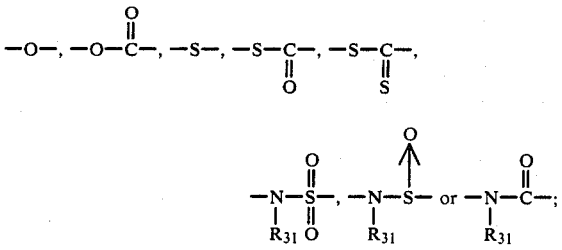

u is an integer of from 1 to 4, preferably being 1, 2 or 3; and $R_{31}$ and $X_{32}$ denote the same meanings as those defined for formula (T-1):

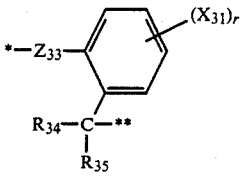

(T-4)

wherein $Z_{33}$ represents —S— or

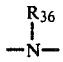

wherein $R_{36}$ expresses an aliphatic, alicyclic or aromatic hydrocarbon group, acyl, sulfonyl or heterocyclic group; $R_{34}$ and $R_{35}$ denote the same meanings as $R_{31}$ defined for formula (T-1); and $X_{31}$ and r denote the same meanings as those defined for formula (T-1).

An example of the group represented by formula (T-4) is the timing group described in U.S. Pat. No. 4,409,323:

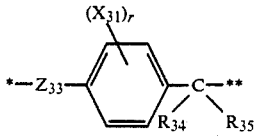

(T-5)

wherein $Z_{33}$, $X_{31}$, $R_{34}$, $R_{35}$, and r denote the same meanings as those defined for formula (T-4):

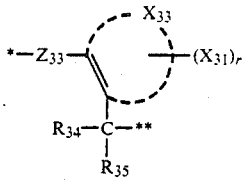

(T-6)

wherein $X_{33}$ is an atomic group which comprises at least one atom selected from the group consisting of carbon, nitrogen, oxygen and sulfur and which is necessary to form a 5- to 7-membered heterocyclic group, which may be further condensed with a benzene ring or a 5- to 7-membered heterocyclic group, exemplarily preferable heterocyclic groups being pyrrole, pyrazole, imidazole, triazole, furan, oxazole, thiophene, thiazole, pyridine, pyridazine, pyrimidine, pyrazine, azepin, oxepin, indole, benzofuran, and quinoline; and $R_{34}$, $R_{35}$, $Z_{33}$, $X_{31}$ and r denote the same meanings as those defined for formula (T-4).

An example of the group represented by formula (T-6) is the timing group described in British Pat. No. 2,096,783:

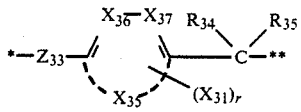

(T-7)

wherein $X_{35}$ is an atomic group which comprises at least one atom selected from the group consisting of carbon, nitrogen, oxygen, and sulfur and which is necessary to form a 5- to 7-membered heterocyclic group, which may be condensed further with a benzene ring or a 5- to 7-membered heterocyclic group, exemplarily preferable heterocyclic groups include pyrrole, imidazole, triazole, furan, oxazole, oxadiazole, thiophene, thiazole, thiadiazole, pyridine, pyridazine, pyrimidine, pyrazine, azepin, oxepin, and isoquinoline; $X_{36}$ and $X_{37}$ are

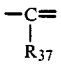

or —N= wherein $R_{37}$ expresses a hydrogen atom, an aliphatic-, alicyclic- or aromatic-hydrocarbon group; and $R_{34}$, $R_{35}$, $Z_{33}$, $X_{31}$ and r denote the same meanings as those defined for formula (T-4):

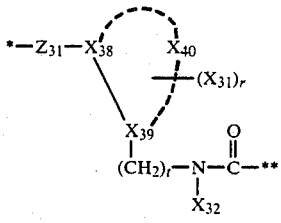

(T-8)

wherein $X_{40}$ is an atomic group which comprises at least one atom selected from the group consisting of carbon, nitrogen, oxygen, and sulfur and which is necessary to form a 5- to 7-membered heterocyclic group, which may be further condensed with a benzene ring or a 5- to 7-membered heterocyclic group, exemplarily preferable heterocyclic groups being pyrrolidine, piperidine, and benzotriazole besides those given for formula (T-6); $X_{38}$ and $X_{39}$ are

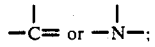

and $Z_{31}$, $X_{31}$, $X_{32}$, t and r denote the same meanings as those defined for formula (T-1):

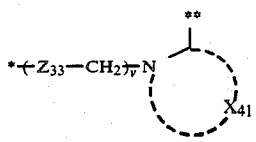

(T-9)

wherein $X_{41}$ denotes the same meaning as $X_{40}$ defined for formula (T-8); $Z_{33}$ denotes the same meaning as that defined for formula (T-4) and v expresses 0 or 1. Exemplarily preferable heterocyclic groups including $X_{41}$ are as follows:

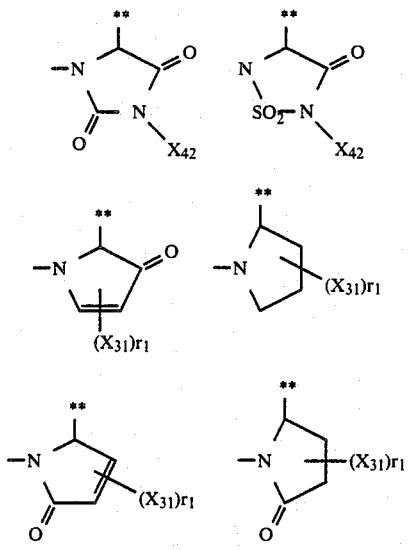

-continued

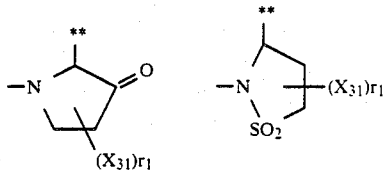

wherein $r_1$ represents an integer of 1 and 2, $X_{31}$ denotes the same meaning as those defined for formula (T-1); and $X_{42}$ represents a hydrogen atom, an aliphatic-, alicyclic-, or aromatic-hydrocarbon group, an acyl, sulfonyl, alkoxycarbonyl, sulfamoyl, heterocyclic, or carbamoyl group:

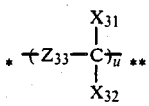

(T-10)

wherein $X_{31}$ and $X_{32}$ denote the same meanings as those defined for formula (T-1), $Z_{33}$ denotes the same meaning as that for formula (T-4) and u denotes the same meaning as that for formula (T-3) and is preferably 1 or 2.

In the above formulae (T-1) to (T-10), $X_{31}$, $X_{32}$, $R_{31}$ to $R_{37}$ have preferably from 1 to 20 carbon atoms, and may be saturated or unsaturated, substituted or unsubstituted, straight or branched chain when they contain an aliphatic hydrocarbon moiety, and have preferably 5 to 20 carbon atoms and may be saturated or unsaturated, substituted or unsubstituted when they have an alicyclic hydrocarbon moiety. The above $X_{31}$, $X_{32}$, $R_{31}$ to $R_{37}$ have from 6 to 20 carbon atoms, preferably from 6 to 10 carbon atoms, and are preferably a substituted or unsubstituted phenyl group when they contain an aromatic hydrocarbon moiety. The above $X_{31}$, $X_{32}$, $R_{31}$ to $R_{37}$ are 5- or 6-membered heterocyclic groups having as hetero atoms at least one member selected from the group consisting of nitrogen, oxygen and sulfur atoms when they contain a heterocyclic moiety. Examples of the preferable heterocyclic groups are a pyridyl, furyl, thienyl, triazolyl, imidazolyl, pyrazolyl, thiadiazolyl, oxadiazolyl or pyrrolidinyl group.

Examples of the preferred timing groups are as follows:

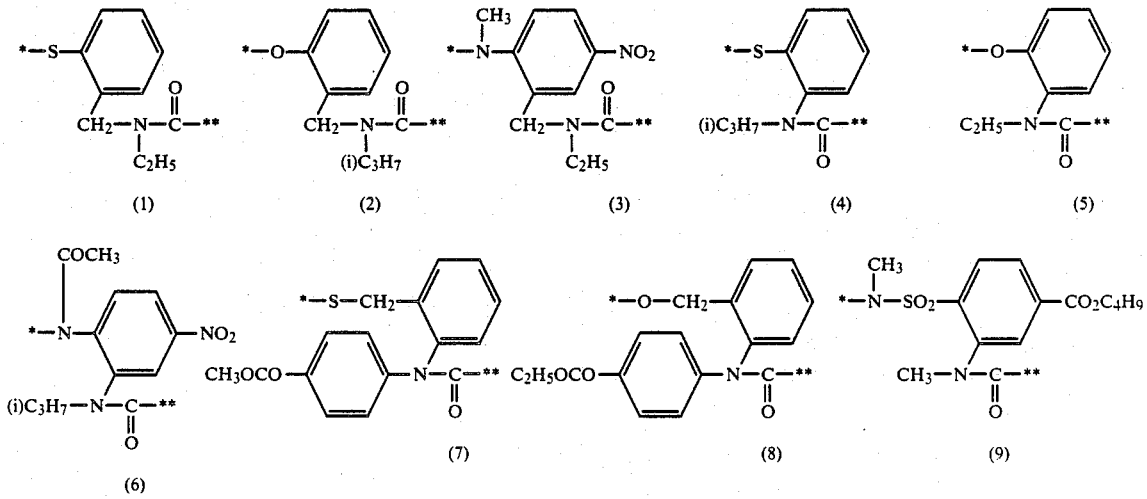

-continued
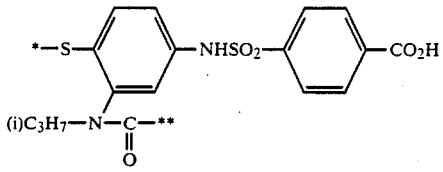
(10)
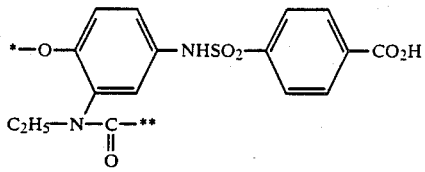
(11)
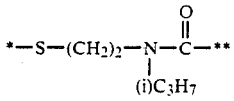
(12)
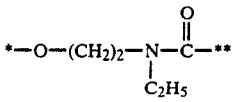
(13)
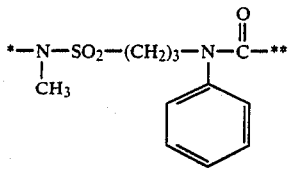
(14)
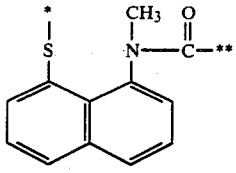
(15)
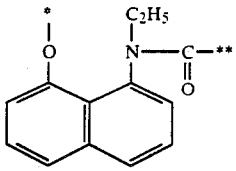
(16)
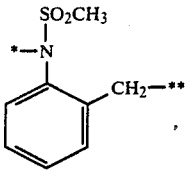
(17)
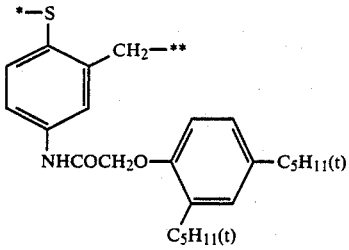
(18)
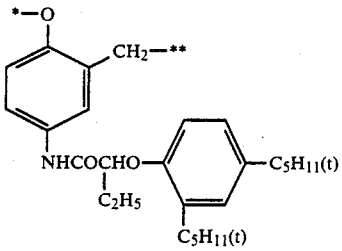
(19)
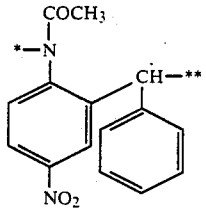
(20)
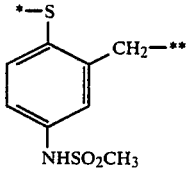
(21)
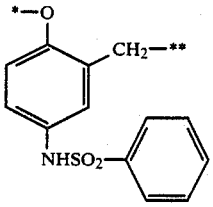
(22)
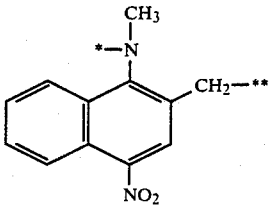
(23)
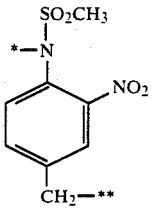
(24)
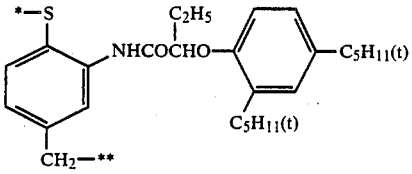
(25)
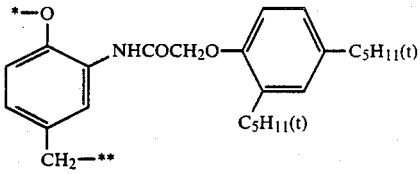
(26)
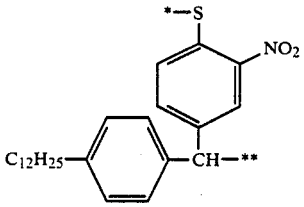
(27)
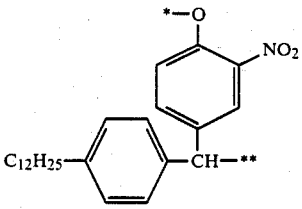
(28)
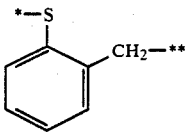
(29)
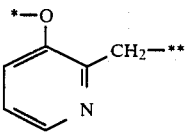
(30)

-continued

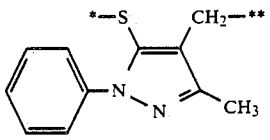

(31)

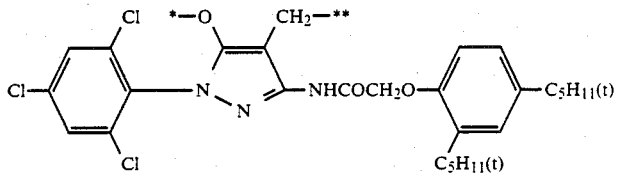

(32)

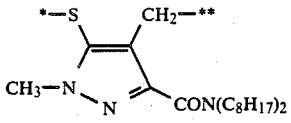

(33)

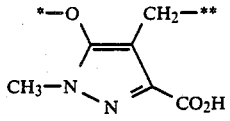

(34)

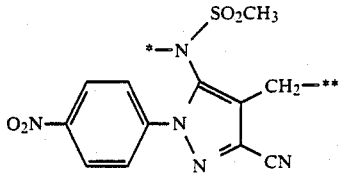

(35)

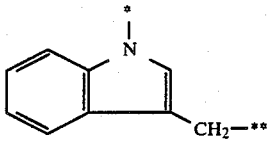

(36)

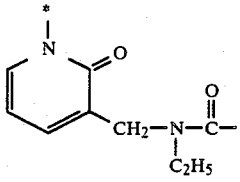

(37)

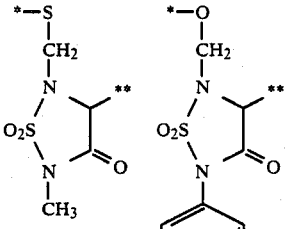

(38)

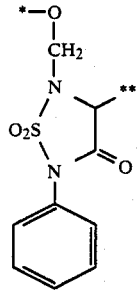

(39)

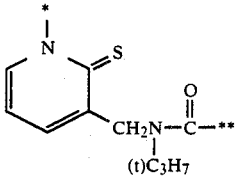

(40)

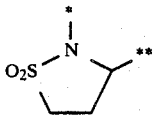

(41)

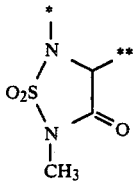

(42)

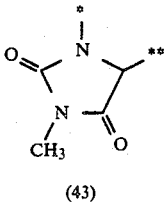

(43)

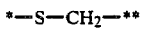

(44)

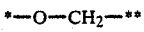

(45)

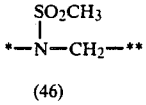

(46)

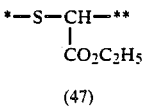

(47)

Examples of the electrophilic center represented by $X_2$ in general formula (I) may be the same groups as those of $X_1$ described in general formula (I).

In general formula (I), Z represents a group of non-metallic atoms which is necessary to form a five- to seven-membered ring and preferably represents a saturated or unsaturated divalent aliphatic group such as alkylene, cycloalkylene, alkenylene, arylene, aralkylene, oxyalkylene, thioalkylene, aminoalkylene, heterocyclene or the like.

R, $R_1$ and $R_2$ may be the same or different from each other and preferably represent a hydrogen atom, a halogen atom, an alkyl group, an alkenyl group, a cycloalkyl group, an aryl group, an alkoxyl group, an acyl group, a sulfonyl group, a heterocyclic residue and the like.

$R_3$ preferably represents an alkyl group, an alkenyl group, a cycloalkyl group, a heterocyclic residue, an aryl group, an aralkyl group and the like.

When $R_1$, $R_2$, $R_3$ and Z are independently a carbon-containing group, the number of carbon atoms preferably ranges from 1 to 18. These groups should preferably be formed so as to impart immobility or semi-immobility to the entire molecule. Most preferably, these groups serve to impart a diffusion resistance property to the entire molecule. If the groups represented by R, $R_1$, $R_2$, $R_3$ and Z are organic substituents, atoms such as carbon, nitrogen or oxygen in the groups may have one or more substituents. The substituent may be further substituted. Typical examples of the substituents include a halogen atom, a cyano group, a nitro group, a hydroxy group, a carboxyl group, a sulfo group, G—, GO—, GS—, GCO—, GCOO—, —$CONH_2$—, —$OCONH_2$, —$SO_2NH_2$, —$NHCONH_2$—, —$NHSO_2NH_2$, —$SO_2G$, —SOG, —COOG, —$NHSO_2G$ and the like (wherein G represents an aliphatic hydrocarbon group, an aryl group or a heterocyclic group).

Of the compounds of general formula (I) of the invention, preferable compounds are represented by the following general formula (II).

General formula (II)

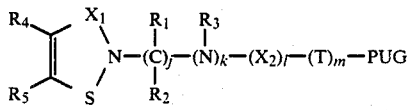

(II)

In the above general formula (II), PUG, T, $X_1$, $X_2$, $R_1$, $R_2$, $R_3$, j, k, l and m have the same meanings as defined in general formula (I), $R_4$ and $R_5$ independently represent a hydrogen atom or an organic substituent.

$R_4$ and $R_5$ in general formula (II) independently represent a hydrogen atom or a substituent. $R_4$ and $R_5$ may be bonded together and may form an aromatic ring represented by a benzene ring, a cycloalkenyl ring represented by a cyclohexene ring or a hetero ring represented by a pyridine ring.

$R_4$ and $R_5$ preferably represent a hydrogen atom, a halogen atom, an alkyl group or a ring formed by the bonding of $R_4$ and $R_5$, and the most preferable ring is a benzene ring. $R_4$ and $R_5$ also may have such a substituent as described for $R_1$ in general formula (I) and the like.

The preferable electrophilic bond represented by $X_2$ in general formula (II) includes a carbonyl group, a sulfonyl group, a thiocarbonyl group and a sulfinyl group.

Of the compounds represented by general formula (II) of the present invention, more preferable compounds are represented by the following general formulae (III) and (IV):

General formula (III)

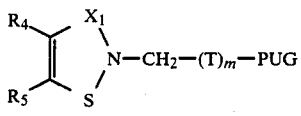

(III)

General formula (IV)

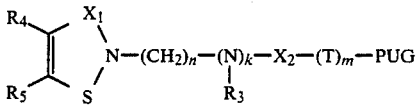

(IV)

In general formula (III), PUG, T, $X_1$, m $R_4$ and $R_5$ have the same meanings as defined in general formula (II).

In general formula (IV), PUG, T, $X_1$, $X_2$, $R_3$, $R_4$, $R_5$ and k have the same meanings as defined in general formula (II). n represents an integer of 1 or 2.

In general formula (III) preferably, $R_4$ and $R_5$ independently represent a hydrogen atom, an alkyl group, a halogen atom or a ring formed by bonding of $R_4$ and $R_5$. $X_1$ preferably represents a carbonyl group or a sulfonyl group and more preferably represents a carbonyl group.

In general formula (IV), preferable examples of $R_4$ and $R_5$ are the same as described in general formula (III). Especially preferred is the example in which n represents 2 and k represents 0.

In general formula (IV), $X_1$ preferably represents a carbonyl group, a thiocarbonyl group or =N—R′ (wherein R′ represents an alkyl group which may be further substituted) and more preferably represents a carbonyl group or a thiocarbonyl group. $X_2$ preferably represents a carbonyl group or a sulfonyl group and more preferably represents a carbonyl group.

In R, R′, $R_1$, $R_2$, $R_3$, $R_4$ and $R_5$ of general formulae (I)–(IV) described above, the alkyl group is a hydrocarbon radical preferably containing from 1 to about 18 carbon atoms, and more preferably from 1 to about 10 carbon atoms; the alkenyl group is a hydrocarbon radical preferably containing from 2 to about 18 carbon atoms, and more preferably containing from 2 to about 10 carbon atoms; the cycloalkyl group is a hydrocarbon radical preferably containing from 3 to about 18 carbon atoms and more preferably containing from about 6 to 12 carbon atoms; the alkoxyl group is a radical preferably containing from 1 to about 18 carbon atoms and more preferably containing 1 to about 10 carbon atoms; the aryl group is a hydrocarbon radical preferably containing from 6 to about 18 carbon atoms, and more preferably containing from 6 to about 12 carbon atoms; and the acyl group is an aliphatic or aromatic acyl group preferably containing from 1 to about 18 carbon atoms and more preferably containing from 1 to about 10 carbon atoms.

The reason why the precursor compounds of the present invention have good stability in the photosensitive film and can release photographically useful reagents rapidly at the time of processing by deprotecting reaction has not been made clear yet, but is presumed as follows.

For example, as shown in the following formula, it is known that 1,2-benzisothiazol-3-one (V) is cleft by the reaction of sulfite ion to form Bunte-salt (VI) (A. W. R. Tyrrell, Tetrahedron Letters, 26, 1753 (1985)). Accordingly, it is assumed that precursor of the present invention which is represented by general formula (I) causes ring cleavage by the attack of a nucleophilic reagent such as sulfite ion, thiophenol, hydroxylamine and the like contained in the processing solution to a sulfur atom of the precursor and releases PUG with good timing as a result of a subsequent electron transfer reaction or an intramolecular ring closure reaction:

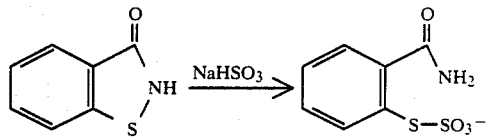

(V) (VI)

These reactions are shown in the following Schemes 1 and 2. Scheme 1 corresponds to the case when j and m are 1, and k and l are 0 in the general formula (I) and Scheme 2 corresponds to the case when j is 2, k and m are 0, l is 1 and $X_1$ is >C=O in general formula (I).

SCHEME 1

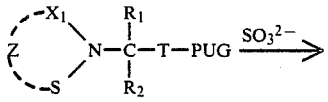

(VII)

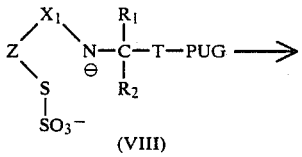

(VIII)

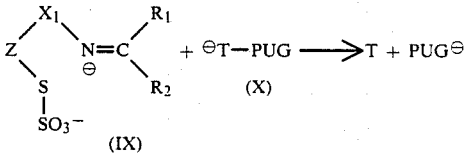

(IX) (X)

SCHEME 2

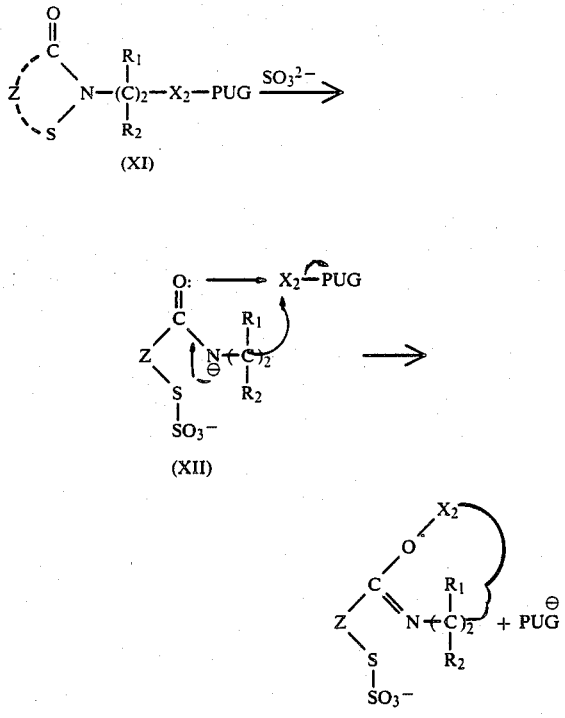

In Scheme 1 and Scheme 2, PUG, T, $R_1$, $R_2$, $X_2$ and Z have the same meanings as described in general formula (I).

The preferred amounts of precursor compounds of the present invention may vary depending on the type of released photographic reagent. The antifoggant and the development restrainer are each added in an amount of from $10^{-8}$ to $10^{-1}$ mole per mole of silver, preferably from $10^{-6}$ to $10^{-1}$ mole for mercapto system antifoggants and from $10^{-5}$ to $10^{-1}$ mole for azole system antifoggant such as benzotriazole. The developing agent is added in amounts of from $10^{-2}$ to 10 moles, preferably from 0.1 to 5 moles, per mole of silver. The pyrazolidone system auxiliary developing agent is used in amounts of from $10^{-4}$ to 10 moles, preferably from $10^{-2}$ to 5 moles, per mole of silver. The development accelerator or nucleating agent is added in amounts of from $10^{-6}$ to $10^{-2}$ mole, preferably from $10^{-5}$ to $10^{-3}$ mole, per mole of silver. The solvent for silver halide such as sodium thiosulfate is added in amounts of from $10^{-3}$ to 10 moles, preferably from $10^{-2}$ to 1 mole, per mole of silver. The dye or colorant for color diffusion transfer photography is added in amounts of from $10^{-3}$ to 1 mole, preferably from $5\times10^{-3}$ to 0.5 moles per mole of silver.

Specific examples of the precursor compounds used in the present invention are shown but should not be construed as limitations.

EXEMPLIFIED COMPOUNDS (I)-(1)

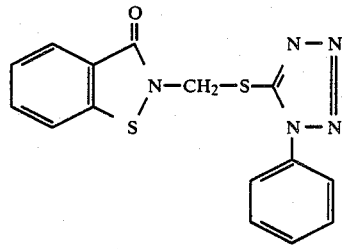

(I)-(2)

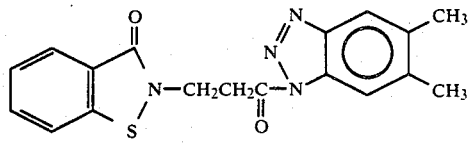

(I)-(3)

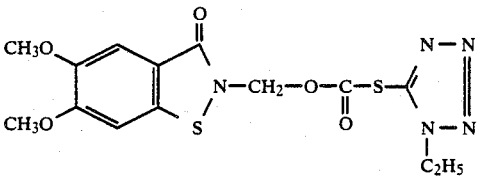

(I)-(4)

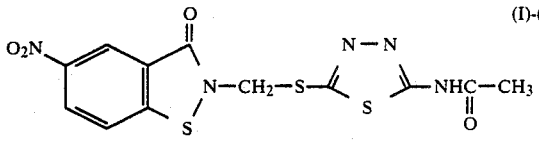

(I)-(5)

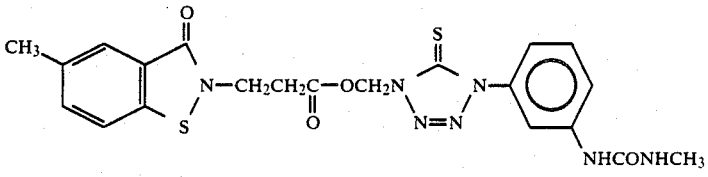

-continued
(I)-(6)
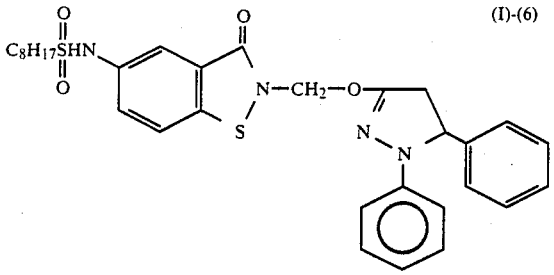
(I)-(7)
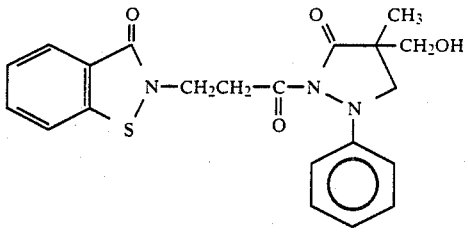
(I)-(8)
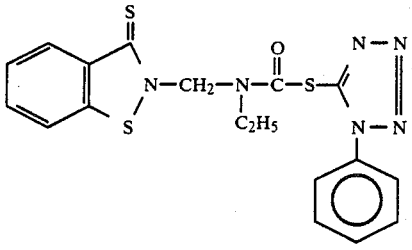
(I)-(9)
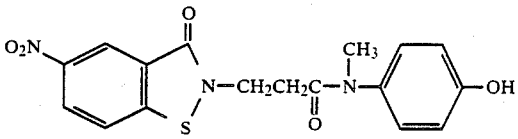
(I)-(10)
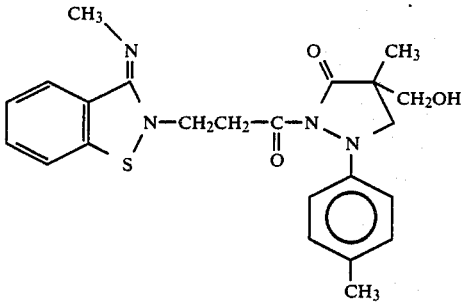
(I)-(11)
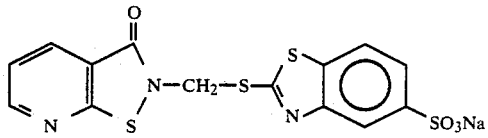
(I)-(12)
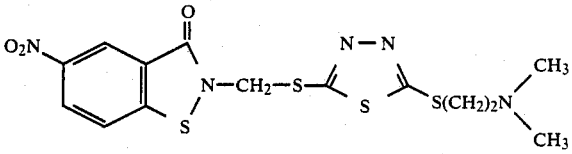
(I)-(13)
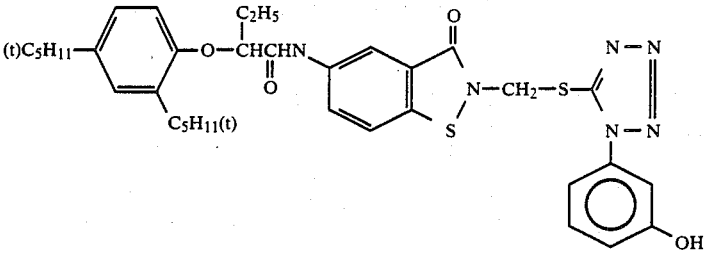
(I)-(14)
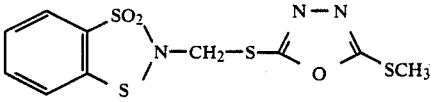
(I)-(15)
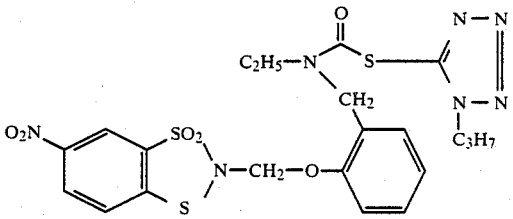

-continued (I)-(16)

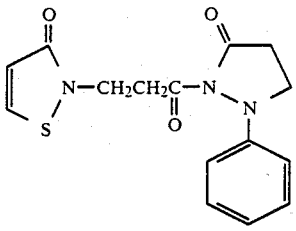

(I)-(17)

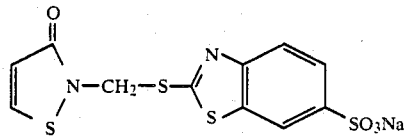

(I)-(18)

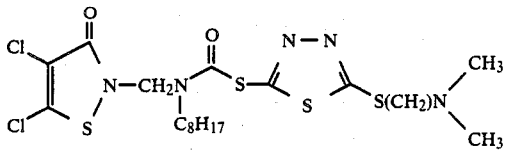

(I)-(19)

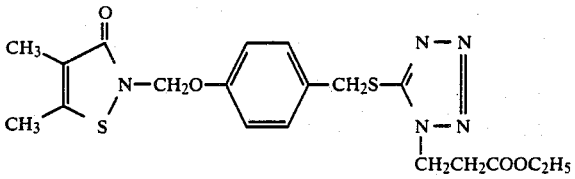

(I)-(20)

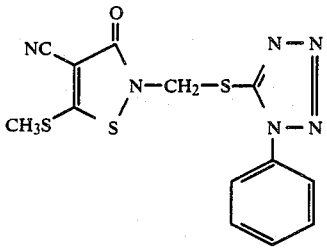

(I)-(21)

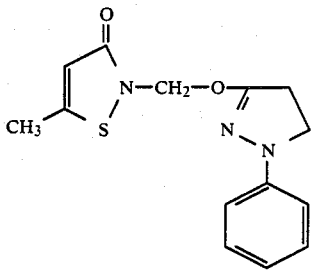

(I)-(22)

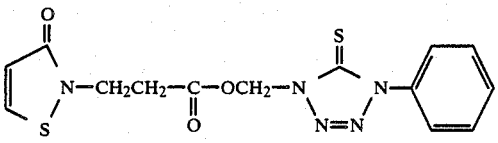

(I)-(23)

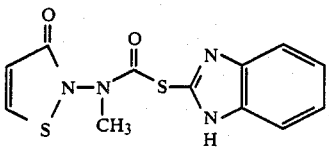

(I)-(24)

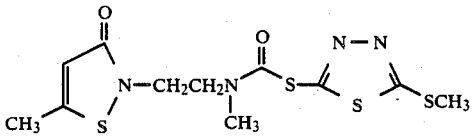

(I)-(25)

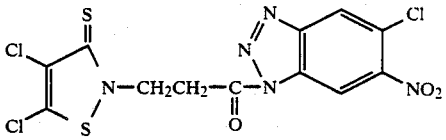

The precursor compounds used in the present invention can be synthesized, for example, according to the method described in the following references as shown in the following Scheme 3 which comprises a substitution reaction to a nitrogen atom after a reaction forming a 1,2-benzothiazole derivative or a 1,2-thiazole derivative, or a ring formation reaction after a substitution reaction to a nitrogen atom (A. W. R. Tyrrell, Tetrahedron Letters, 26, 1753 (1985), W. D. Crow and N. J. Leonard, Journal of the Organic Chemistry 30, 2660 (1965)).

SCHEME 3

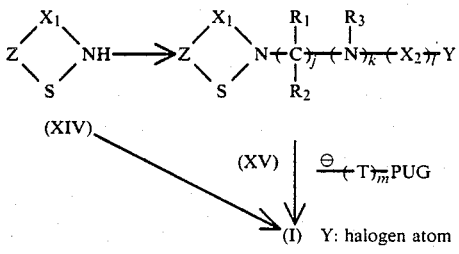

-continued

SCHEME 3

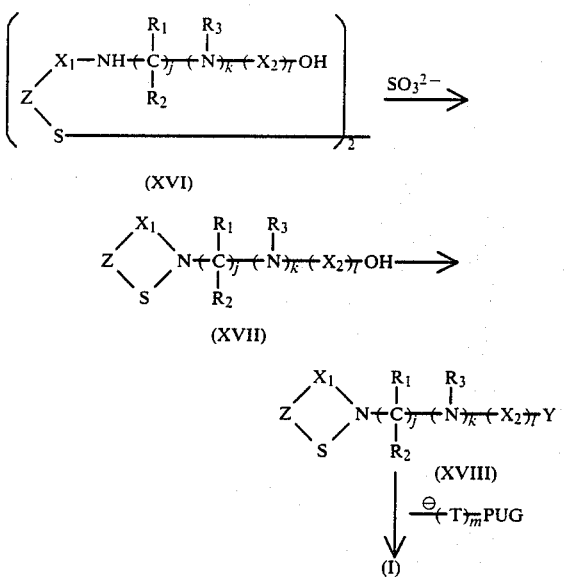

The following examples are exemplary of the synthesis of the precursor compounds according to the present invention.

SYNTHESIS EXAMPLE 1

Synthesis of exemplified compound (I)-(1):

1,2-benzisothiazole-3-one (30.2 g, 0.2 mol) and 30% aqueous formalin solution (30 ml, 0.3 mol) were added to a mixed solvent of dioxane (10 ml) and water (20 ml) and the resultant solution was heated at 100° C. for 5 hours. Then the solution was cooled to separate out crystal, which was subjected to filtration to obtain crude N-hydroxymethyl-1,2-benzisothiazole-3-one crystal. 20 g of the crude crystal was added to benzene (100 ml), and phosphorus tribromide (30 mg, 0.11 mol) was added dropwise thereto. Then, the solution was heated for 2 hours while stirring, which followed a benzene phase was taken out and benzene was removed by evaporation under reduced pressure to obtain crude N-bromobenzene-1,2-benzisothiazole-3-one crystals. 13 g of the crude crystals was added to tetrahydrofuran (100 ml), and a solution of sodium salt of 1-phenyl-5-mercaptotetrazole (10 g, 0.05 mol) in tetrahydrazone (50 ml) was added dropwise thereto in about 20 minutes. Subsequently, the stirring was continued at room temperature for 2 hours. Crude crystals obtained by subjecting the resultant reaction solution to vacuum condensation was isolated by silica gel chromatography to obtain 11.3 g of exemplified compound (I)-(1). The structure was identified by mass spectrometry and NMR spectrography.

SYSTHESIS EXAMPLE 2

Synthesis of exemplified compound (I)-(16):

A solution of 1-phenyl-2-(3-chloropropionyl)-3-pyrazolidone (12.7 g, 0.05 mol) in tetrahydrofuran (30 ml) was added dropwise to a solution of 3-isothiazolone (5 g, 0.05 mol) and t-butoxy potassium (6.2 g, 0.055 mol) in tetrahydrofuran (50 ml) at about 5° C. The resultant solution was stirred at room temperature for 1 hour and then poured to ice water. The solution was extracted with ethyl acetate. The extract was dried with anhydrous sodium sulfate, from which the solvent was evaporated off to give a crude product. Purification of the crude product by silica gel chromatography resulted in 7.5 g of exemplified compound (I)-(16). The structure was identified by mass spectrography and NMR spectrography.

The photographic reagent precursors used in the present invention may be used solely or as a combination thereof.

The blocked photographic reagents precursors of the present invention may be added to any layer of a silver halide photographic material including a silver halide emulsion layer, a colorant layer, an undercoat layer, a protective layer, an intermediate layer, a filter layer, an anit-halation layer, an image-receiving layer for a black-and-white or color diffusion transfer method, or a cover sheet or other auxiliary layer.

For the addition of these precursors to these layers, precursors may be added directly to a coating solution to form an intended layer or after dissolution in a solvent, which does not have an adverse influence on the photographic material, e.g. in water or an alcohol. Alternatively, precursors may be dissolved in high boiling and/or low-boiling solvents and added for emulsification and dispersion in an aqueous solution. Still alternatively, precursors may be added after impregnation with polymer latex as described in Japanese Patent Application (OPI) Nos. 39853/76, 59942/76 and 32552/79 and U.S. Pat. No. 4,199,363.

The precursors of the present invention may be added to any stage of a manufacturing process of the photographic material and are added preferably just before their application.

The precursors of the invention may be used, for example, in color photographic materials of the coupler type.

A subtractive color process is an ordinary process for forming a color image from a color photographic material, in which there are used silver halide emulsions which selectively sensitize to blue, green and red lights respectively and color image forming agents of yellow, magenta and cyan which are in complementary relations with the blue, green and red.

In general, color photographic materials may be broadly classified into two types including a coupler-in-developer-type in which couplers are incorporated in a developer and a coupler-in-emulsion type in which couplers are incorporated in the respective photosensitive layer of the photographic material so as to keep the respective performances independently. In the latter case, a coupler for forming a dye image is added to a silver halide emulsion. The coupler added to the emulsion should be resistant to diffusion in an emulsion binder matrix.

In the coupler-in-emulsion type, the processing steps of the color photographic material fundamentally consist of the following three steps:

(1) Color developing step
(2) Bleaching step
(3) Fixing step.

The bleaching and fixing steps may be conducted simultaneously. Namely, it is the bleaching and the fixing step, a so-called blix step, in which desilvering is conducted for the developed silver and non-developed silver halide. The practical development treatment includes, aside from the two fundamental steps of the above color developing and desilvering, an auxiliary step for keeping good photographic and physical qualities of an image or for enabling an image to be well preserved. For instance, there is included a step of using a hard film bath for preventing excess softening of a processed photographic film, a suspension bath by which the developing reaction is effectively stopped, an image-stabilizing bath for stabilizing an image and/or a film-removing bath in which a backing layer is removed from a base.

In order to introduce couplers into the silver halide photographic material of the invention, conventionally known methods may be used including a method of adding couplers to emulsions or dispersing couplers in emulsions, and a method of adding couplers to gelatin/-silver halide emulsions or hydrophilic colloids. More particularly, there are known methods in which couplers are mixed with and dispersed in high-boiling organic solvents such as dibutyl phthalate, tricresyl phosphate, wax and higher fatty acids and esters thereof as described, for example, in U.S. Pat. Nos. 2,304,939 and 2,322,027. Other known methods are methods in which couplers are mixed with and dispersed in low-boiling organic solvents or water-soluble organic solvents with or without high-boiling organic solvents as described, for example, in U.S. Pat. Nos. 2,801,170, 2,801,171 and 2,949,360. If couplers are sufficiently low in melting point of, for example, below 75° C., there is used a method of dispersing couplers with or without combination with other types of couplers such as colored couplers or uncolored couplers as described, for example, in German Pat. No. 1,143,707.

Examples of auxiliary dispersing agents ordinarily used include anionic surface active agents (e.g., sodium alkylbenzenesulfonates, sodium dioctylsulfosuccinate, sodium dodecylsulfate, sodium alkylnaphtalenesulfonates, Fisher-type couplers), amphoteric surface active agents (e.g., N-tetradecyl-N,N-dipolyethylene-α-betaine), and nonionic surface active agents (e.g., sorbitan monolaurate).

The photographic emulsion layer of the photographic material of the invention may comprise color-forming couplers i.e., compounds capable of color developing by oxidative coupling with aromatic primary amine developing agents (e.g., phenylenediamine derivatives and aminophenol derivatives), in the color development processing. Examples of such magenta couplers include 5-pyrazolone coupler, pyrazolobenzimidiazole coupler, cyanoacetylcumarone coupler, ring-closed acylacetonitrile couplers and the like. Examples of yellow couplers include acylacetoamide couplers (e.g., benzoylacetoanilides, pivaloylacetoanilides). Examples of cyan couplers include naphthol couplers and phenol couplers. These couplers should preferably be non-diffusible as having a hydrophobic group called a ballast group. Couplers may be either of four equivalents or two equivalents with respect to silver ion. Further, colored couplers having the effect of color correction or couplers capable of releasing a development restrainer as development proceeds (DIR couplers) may also be used. Aside from DIR couplers, colorless DIR coupling compounds in which a coupling reaction product is colorless and is capable of releasing a development restrainer may be contained.

When the photographic element of the present invention is applied to a color diffusion transfer photography, the element may be a film unit of a peel-apart type, an integrated type as described in Japanese Patent Publication Nos. 16356/71 and 33697/73, Japanese Patent Application (OPI) No. 13040/75 and British Pat. No. 1,330,524, and a peel-apart-free type as described in Japanese Patent Application (OPI) No. 119345/82.

The compounds of the invention may be used in black and white photographic materials. Examples of such materials include X-ray films for medical service, black and white films for ordinary photography, lith films, scanner films and the like.

The silver halide photographic materials of the invention are not critical with respect to the method of preparing silver halide emulsions, halogen compositions, crystal habit, particle size, chemical sensitizers, anti-foggants, stabilizers, surface active agents, gelatin hardening agents, hydrophilic colloidal binders, matting agents, dyes, sensitizing dyes, anti-bleaching agents, color-mixing preventing agents, polymer latices, brightening agents, antistatic agents and the like. In this connection, reference should be made to Research Disclosure Vol. 176, pages 22 to 31 (December, 1978).

The manner of exposure and development of the silver halide photographic material of the invention is not critical. For instance, known methods and processing solutions as described in the above-indicated Research Disclosure, on pages 28 to 30 may be employed in the practice of the invention. The photographic processing may be either a photographic processing of forming a silver image (black and white photographic processing) or a processing of forming a dye image (color photographic processing). The processing temperature is generally selected from 18° C. to 50° C. However, temperatures lower than 18° C. or higher than 50° C. may be used. Especially, in the case of processing at a temperature higher than 50° C., it is preferable to proceed the development reaction in an alkaline bath or by contacting with an alkaline sheet using a color developing agent contained in a photographic material. Also, the photographically useful reagent precursors of the present invention may be applied for a heat development or applied to a photosensitive material for the high-temperature development described in U.S. Pat. No. 4,500,626, Japanese Patent Application (OPI) Nos. 218,443/1984 and 133,449/1985, Japanese Patent Application No. 79,709/1985.

A preferable pH range of the developing solution used for the silver halide photographic material of the present invention is from about 9 to 12 and an especially preferable pH range is from about 9.5 to 10.5.

The developing solution used for black and white photographic processing may contain any known developing agents. Examples of such agents include dihydroxybenzenes such as hydroquinone, 3-pyrazolidones such as 1-phenyl-3-pyrazolidone, aminophenols such as N-methyl-p-aminophenol and the like. These agents may be used solely or in combination. The developing solution generally comprises other known preservatives, alkalis, pH buffering agents, antifoggants and the like and, if necessary, dissolving aids, toning agents, development promotors, surface active agents, antifoamers, hard water softening agents. hardening agents, viscosity-increasing agents and the like.

The photographic emulsion of the invention may be applied with a so-called "lith-type" development processing. In this development processing developing steps are contagiously effected using dihydroxybenzenes as the developing agent under a low concentration of sulfite ions in order to photographically reproduce a line image or a half-tone image.

The color developing solution generally consists of an aqueous alkaline solution containing a color developing agent. The color developing agent may be known aromatic amines including, for example, phenylenediamines such as 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoamidoethylaniline, 4-amino-3-methyl-N-ethyl-N-β-methoxyethylaniline and the like.

Further, there may be used those described by L. F. A. Mason, Photographic Processing Chemistry (Focal Press) (1966), pp. 226–229 and also in U.S. Pat. Nos. 2,193,015 and 2,592,364, and Japanese Patent Application (OPI) No. 64933/73.

The silver halide photographic material of the present invention has the effect that the photographic material can be stably present under preservation conditions and the other effect that the photographic reagent can be timely relesed rapidly and effectively, when needed at the time of the processing. Particularly with regard to the silver halide photographic material of the present invention, the release of the photographic reagent can timely be achieved, even if the photographic material is processed with the processing solution having a relatively low pH such as 9 to 12.

Furthermore, the present invention possesses excellent effects such as the prevention of desensitization due to the addition of the photographic reagent precursor and the performance of the function of the released photographic reagent.

The present invention will be described in detail in reference to the following examples, but the latter do not intend to limit the scope of the present invention.

EXAMPLE 1

The effectiveness of an antifoggant precursor of the present invention was evaluated by the use of compounds of the present invention and control (comparative) compounds. Antifoggants and blocked antifoggants (antifoggant precursors) of the present invention which were set forth in Table 1 were each dissolved and emulsified in an aqueous gelatin solution containing tricresyl phosphate together with a coupler (Cp-1) to prepare an emulsifying dispersion, and the latter was then added to a silver iodobromide emulsion. Cellulose triacetate film bases provided with primer layers were then coated with the thus prepared emulsions. Furthermore, protective layers were coated on the emulsion layers respectively in order to prepare Samples 1 to 5. Amounts of the respective coating materials will be given with a unit of "g/cm$^2$" or "mol/m$^2$" in parentheses.

(1) Emulsion layer:
- Negative silver iodobromide emulsion; grain size = 1.4 μm (silver content = $1.6\times10^{-2}$ mol/m$^2$)
- Magenta coupler Cp-1 ($1.3\times10^{-3}$ mol/m$^2$)
- Antifoggants or their precursors (as shown in Table 1)
- Gelatin (2.50 g/m$^2$)

(2) Protective layer:
- Gelatin (1.30 g/m$^2$)
- Sodium salt of 2,4-dichloro-6-hydroxy-s-triazine (0.05 g/m$^2$)

After being left to stand at a temperature of 40° C. and relative humidity of 70% for 14 hours, these photographic elements were exposed to a 25 CMS having a color temperature adjusted to 4,800° K. by a filter using a tungsten light source, and were processed at a temperature of 38° C. in accordance with the following processing steps:

| | |
|---|---|
| Color development | 3 min 15 sec |
| Bleaching | 6 min 30 sec |
| Washing | 2 min 10 sec |
| Fixing | 4 min 20 sec |
| Washing | 3 min 15 sec |
| Stabilization | 1 min 5 sec |

Compositions of the processing solutions used in the respective steps were as follows:

| | |
|---|---|
| Color developing solution: | |
| Diethylenetriaminepentaacetic acid | 1.0 g |
| 1-Hydroxyethylidene-1,1-diphosphonic acid | 2.0 g |
| Sodium sulfite | 4.0 g |
| Potassium carbonate | 30.0 g |
| Potassium bromide | 1.4 g |
| Potassium iodide | 1.3 mg |
| Hydroxylamine sulfate | 2.4 g |
| 4-(N—Ethyl-N—β-hydroxyethylamino)-2-methylaniline sulfate | 4.5 g |
| Water | q.s. to 1.0 liter (pH = 10.0) |
| Bleaching solution: | |
| Ferric ammonium ethylenediamine-tetraacetate | 100.0 g |
| Disodium ethylenediamine-tetraacetate | 10.0 g |
| Ammonium bromide | 150.0 g |
| Ammonium nitrate | 10.0 g |
| Water | q.s. to 1.0 liter (pH = 6.0) |
| Fixer: | |
| Disodium ethylenediamine-tetraacetate | 1.0 g |
| Sodium sulfite | 4.0 g |
| Aqueous ammonium thiosulfate solution (70%) | 175.0 ml |
| Sodium bisulfite | 4.6 g |
| Water | q.s. to 1.0 liter (pH = 6.6) |
| Stabilizer: | |
| Formalin (40%) | 2.0 ml |
| Polyoxyethylene-p-monononyl phenyl ether (average polymerization degree = about 10) | 0.3 g |
| Water | q.s to 1.0 liter |

Photographic properties of the thus processed samples are set forth in Table 1.

TABLE 1

| Sample No. | Antifoggant or its Precursor | Amount mol/m$^2$ | Fog | Gamma | Relative* Sensitivity | Maximum Color Density |
|---|---|---|---|---|---|---|
| 1 | None (Control) | — | 0.14 | 0.79 | 100 | 1.59 |
| 2 | Exemplified Compound (I)-(1) | $2.0\times10^{-6}$ | 0.08 | 0.77 | 97 | 1.56 |
| 3 | Exemplified | $4.0\times10^{-6}$ | 0.09 | 0.76 | 98 | 1.57 |

TABLE 1-continued

| Sample No. | Antifoggant or its Precursor | Amount mol/m$^2$ | Fog | Gamma | Relative* Sensitivity | Maximum Color Density |
|---|---|---|---|---|---|---|
| | Compound (I)-(22) | | | | | |
| 4 | Comparative Compound 1-A | $2.0 \times 10^{-6}$ | 0.04 | 0.67 | 78 | 1.27 |
| 5 | Comparative Compound 1-B | $4.0 \times 10^{-6}$ | 0.05 | 0.40 | 28 | 1.02 |

*Relative sensitivity: A reciprocal number of an exposure for providing a color density of fog + 0.2, and its value for each sample was obtained as a value relative to the reciprocal number of the control sample regarded as 100. The same rule applies correspondingly to Table 2 below.

It is apparaent from the results shown in Table 1 that with regard to Samples 2 and 3 in which the precursor compounds of the present invention were used, the photographic fog was diminished, the sensitivity being scarcely deteriorated.

On the contrary, in the case of the precursor compound disclosed in Japanese Patent Application (OPI) No. 135949/1982 or an antifoggant directly added (Samples 4 and 5), the sensitivity was greatly deteriorated.

As a consequence, the antifoggant precursor of the present invention can be stably present in the photographic element film, and at the time of the processing, the antifoggant can be released to thereby diminish the photographic fog specifically without any desensitization.

The structure of the antifoggants (development restrainers) used for comparison and the coupler are as follows:

Comparative compound 1-A

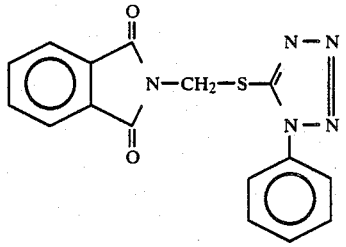

Comparative compound 1-B

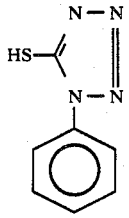

Coupler Cp-1

-continued

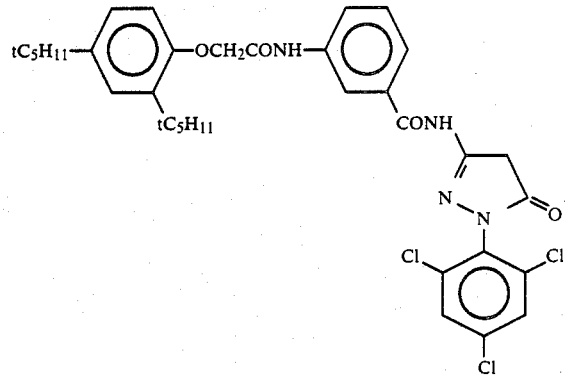

EXAMPLE 2

The effectiveness of an auxiliary developing agent precursor of the present invention was evaluated by the use of compounds of the present invention and control (comparative) compounds. In the first place, a photographic element consisting of the undermentioned emulsion layer and protective layer was formed. The preparation of the emulsion layer and the protective layer as well as the coating manner of these layers was as follows: Auxiliary developing agents and their precursors of the present invention which were set forth in Table 2 were each dissolved and emulsified in an aqueous gelatin solution containing tricresyl phosphate together with a coupler (Cp-1) to prepare an emulsifying dispersion, and the latter was then added to a silver iodobromide emulsion. A cellulose triacetate film base provided with a primer layer was then coated with each of the thus prepared emulsions. Furthermore, the protective layers were coated on the emulsion layer respectively in order to prepare Samples 6 to 10. Amounts of the respective coating materials will be given with a unit of "g/cm$^2$" or "mol/m$^2$" in parentheses.

(1) Emulsion layer:
- Negative silver iodobromide emulsion;
  - grain size = 1.4 $\mu$m
  - (silver content = $1.6 \times 10^{-2}$ mol/m$^2$)
- Magenta coupler Cp-1
  - ($1.33 \times 10^{-3}$ mol/m$^2$)
- Auxiliary developing agents or their precursors
  - ($1.33 \times 10^{-3}$ mol/m$^2$)
- Gelatin (2.50 g/m$^2$)

(2) Protective layer:
- Gelatin (1.30 g/m$^2$)
- Sodium salt of 2,4-dichloro-6-hydroxy-s-triazine (0.05 g/m$^2$)

These film samples were allowed to stand under conditions of 40° C. and a relative humidity of 70% for 14 hours, and the same color development as in Example 1 was then carried out after giving imagewise an exposure for sensitometry.

The photographic properties thus obtained are set forth in Table 2.

TABLE 2

| Sample No. | Auxiliary Developing Agent or its Precursor | Fog | Gamma | Relative Sensitivity | Maximum Color Density |
|---|---|---|---|---|---|
| 6 | None (Control) | 0.14 | 0.79 | 100 | 1.59 |
| 7 | Exemplified Compound (I)-(6) | 0.14 | 0.86 | 119 | 1.70 |
| 8 | Exemplified Compound (I)-(16) | 0.14 | 0.80 | 116 | 1.68 |
| 9 | Comparative Compound 2-A | 0.14 | 0.77 | 101 | 1.60 |
| 10 | Comparative Compound 2-B | 0.17 | 0.90 | 81 | 1.76 |

As is apparent from Table 2, in regard to the samples to which the auxiliary developing agents were directly added, the increase in the photographic fog and the occurrence of desensitization were observed, but in Samples 8 and 9 in which the compounds of the present invention were employed, the photographic fog was hardly increased and sensitization was obtained. On the contrary, in the case of auxiliary developing agent precursor (2-A) disclosed in Japanese Patent Application (OPI) No. 53330/1980 (Sample 9), the sensitivity scarcely increased. Further in the case of the auxiliary developing agent directly added (Sample 10), photographic fog increased and desensitization was caused.

The structure of the comparative compounds 2-A and 2-B are as follows:

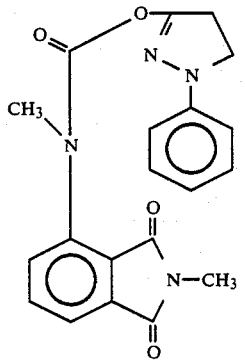

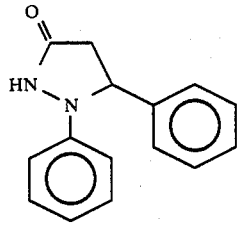

As many apparently widely different embodiments of this invention may be made without departing from the spirit and scope thereof, it is to be understood that the present invention is not limited to the specific embodiment thereof except as defined in the appended claims.

What we claim is:

1. A silver halide photographic material containing at least one photosensitive silver halide emulsion layer and comprising at least one kind of photographic reagent precursor represented by the following general formula (I):

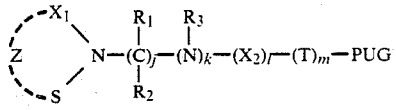

(I)

wherein $X_1$ represents a carbonyl group, a thiocarbonyl group, a sulfonyl group, a sulfinyl group or =N—R (wherein R represents a hydrogen atom or an organic substituent); $X_2$ represents a electrophilic center; Z represents a group of non-metallic atoms forming a five- to seven-membered ring; PUG represents a photographically useful group; $R_1$ and $R_2$ independently represent a hydrogen atom or an organic substituent; $R_3$ represents an organic substituent; T represents a timing group; and j is an integer of from 0 to 3, k, l and m are independently 0 or 1, with the provision that when k is 1, l is 1 and when j is 1, k and l are 1.

2. A silver halide photographic material according to claim 1, wherein the photographically useful group represented by PUG in general formula (I) is selected from a photographic reagent bonded through a hetero atom, comprising an antifoggant or a development restrainer including mercaptotetrazoles, mercaptotriazoles, mercaptopyrimidines, mercaptobenzimidazoles, mercaptothiadiazoles, benzotriazoles and imidazoles; a developing agent including p-phenylendiamines, hydroquinones and p-aminophenols; an auxiliary developing agent including pyrazolidones; a nucleating agent including hydrazines and hydrazides; a solvent for silver halide including sodium thiosulfate; a bleach promoter including aminoalkylthiols; an azo dye; an azomethine; and a dye photographic reagent which has the redox function capable of releasing the above-indicated photographic reagents as a function of development including a colorant for color diffusion transfer sensitive materials and a DIR-hydroquinone.

3. A silver halide photographic material according to claim 1, wherein T in general formula (I) is selected from the group represented by the following general formulae (T-1) to (T-9) and a combination thereof, wherein symbol* expresses the position at which the residue except PUG and the timing group are bonded, and symbol** expresses the position at which PUG is bonded:

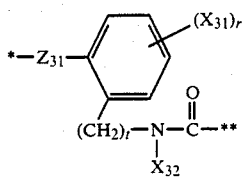

(T-1)

wherein $Z_{31}$ represents

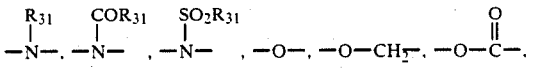

-continued

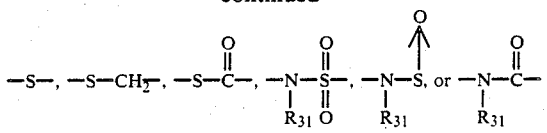

wherein $R_{31}$ is a hydrogen atom, an aliphatic, alicyclic, or aromatic hydrocarbon group, or a heterocyclic group; $X_{31}$ represents an aliphatic, alicyclic or aromatic hydrocarbon group or a heterocyclic group,

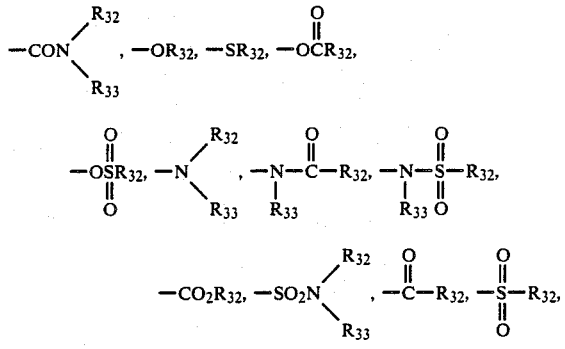

a cyano group, halogen atoms or a nitro group wherein $R_{32}$ and $R_{33}$ may be or may not be identical and express the same groups as described for $R_{31}$; $X_{32}$ represents the same groups as described for $R_{31}$; r represents an integer of from 0 to the total number of hydrogen atoms in the ring which are able to be substituted (in formula (T-1) r represents an integer of from 0 to 4), and when r is 2 or more, the substituent represented by $X_{31}$ may be or may not be identical, and when r is 2 or more, $X_{31}$ may link to each other to form a ring; and t represents 0, 1 or 2:

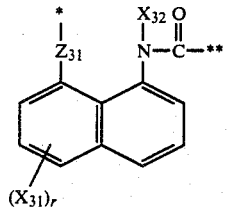

(T-2)

wherein $Z_{31}$, $X_{31}$, $X_{32}$ and r have the same meanings as those defined for formula (T-1):

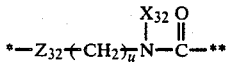

(T-3)

wherein $Z_{32}$ represents

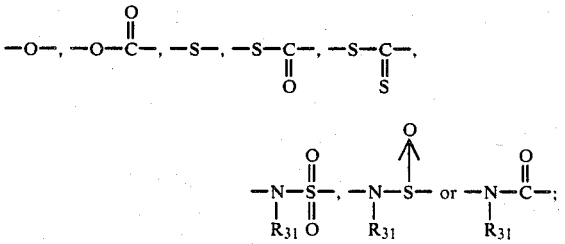

u is an integer of from 1 to 4; and $R_{31}$ and $X_{32}$ have the same meanings as those defined for formula (T-1):

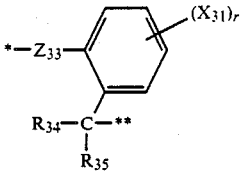

(T-4)

wherein $Z_{33}$ represents —S— or

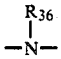

wherein $R_{36}$ expresses an aliphatic, alicyclic or aromatic hydrocarbon group, acyl, sulfonyl or heterocyclic group; $R_{34}$ and $R_{35}$ have the same meanings as $R_{31}$ defined for formula (T-1); and $X_{31}$ and r have the same meanings as those defined for formula (T-1):

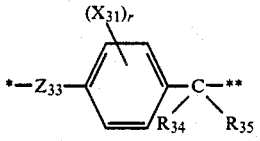

(T-5)

wherein $Z_{33}$, $X_{31}$, $R_{34}$, $R_{35}$, and r have the same meanings at those defined for formula (T-4):

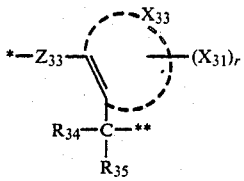

(T-6)

wherein $X_{33}$ is an atomic group which comprises at least one atom selected from the group consisting of carbon, nitrogen, oxygen and sulfur and which is necessary to form a 5- to 7-membered heterocyclic group, which may be further condensed with a benzene ring or a 5- to 7-membered heterocyclic group and $R_{34}$, $R_{35}$, $Z_{33}$, $X_{31}$ and r have the same meanings as those defined for formula (T-4):

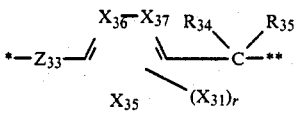

(T-7)

wherein $X_{35}$ is an atomic group which comprises at least one atom selected from the group consisting of carbon, nitrogen, oxygen, and sulfur and which is necessary to form a 5- to 7-membered heterocyclic group, which may be condensed further with a benzene ring or a 5- to 7-membered heterocyclic group, each $X_{36}$ and $X_{37}$ is

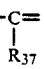

or —N= wherein $R_{37}$ represents a hydrogen atom, an aliphatic-, alicyclic- or aromatic-hydrocarbon group; and $R_{34}$, $R_{35}$, $Z_{33}$, $X_{31}$ and r have the same meanings as those defined for formula (T-4):

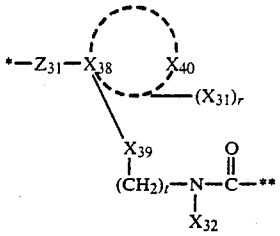

(T-8)

wherein $X_{40}$ is an atomic group which comprises at least one atom selected from the group consisting of carbon, nitrogen, oxygen, and sulfur and which is necessary to form a 5- to 7-membered heterocyclic group, which may be further condensed with a benzene ring or a 5- to 7-membered heterocyclic group, $X_{38}$ and $X_{39}$ are $$-\overset{|}{C}= \text{ or } -\overset{|}{N}-;$$

and $Z_{31}$, $X_{31}$, $X_{32}$, t and r have the same meanings as those defined for formula (T-1):

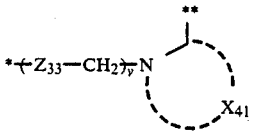

(T-9)

wherein $X_{41}$ has the same meaning as $X_{40}$ defined for formula (T-8); $Z_{33}$ has the same meaning as that defined for formula (T-4) and v represents 0 or 1.

4. A silver halide photographic material according to claim 1, wherein Z in general formula (I) is selected from a saturated or unsaturated divalent aliphatic group.

5. A silver halide photographic material according to claim 1, wherein R, $R_1$, $R_2$ and $R_3$ in general formula (I) may be the same or different from each other and independently represent a hydrogen atom, a halogen atom, an alkyl group, an alkenyl group, a cycloalkyl group, an aryl group, an alkoxyl group, an acyl group, a sulfonyl group or a heterocyclic residue.

6. A silver halide photographic material according to claim 1, wherein the electrophilic center represented by $X_2$ in general formula (I) is a carbonyl group, a thiocarbonyl group, a sulfonyl group, a sulfinyl group or =N—R (wherein R represents a hydrogen atom or an organic substituent).

7. A silver halide photographic material according to claim 1, wherein said precursor is selected from the compound represented by the following general formula (II):

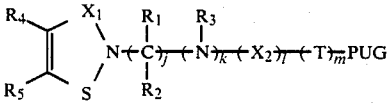

(II)

wherein PUG, T, $X_1$, $X_2$, $R_1$, $R_2$, $R_3$, j, k, l and m have the same meanings as defined in general formula (I), and $R_4$ and $R_5$ independently represent a hydrogen atom or an organic substituent.

8. A silver halide photographic material according to claim 7, wherein $R_4$ and $R_5$ in general formula (II) independently represent a hydrogen atom, a halogen atom, an alkyl group or a ring formed by bonding of $R_4$ and $R_5$.

9. A silver halide photographic material according to claim 7, wherein the electrophilic center represented by $X_2$ in general formula (II) is a carbonyl group, a sulfonyl group, a thiocarbonyl group or a sulfinyl group.

10. A silver halide photographic material according to claim 7, wherein said precursor is selected from the compound represented by the following general formula (III):

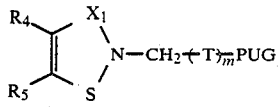

(III)

wherein PUG, T, $X_1$, m, $R_4$ and $R_5$ have the same meanings as defined in general formula (II).

11. A silver halide photographic material according to claim 10, wherein $R_4$ and $R_5$ in general formula (III) independently represent a hydrogen atom, an alkyl group, a halogen atom or a ring formed by the bonding of $R_4$ and $R_5$, and $X_1$ in general formula (III) is a carbonyl group or a sulfonyl group.

12. A silver halide photographic material according to claim 7, wherein said precursor is selected from the compound represented by the following general formula (IV):

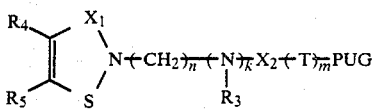

(IV)

wherein PUG, T, $X_1$, $X_2$, $R_3$, $R_4$, $R_5$ and k have the same meanings as defined in general formula (II), and n is an integer of 1 or 2.

13. A silver halide photographic material according to claim 12, wherein $R_4$ and $R_5$ in general formula (IV) independently represent a hydrogen atom, an alkyl group, a halogen atom or a ring formed by the bonding of $R_4$ and $R_5$, and n is 2 and k is 0.

14. A silver halide photographic material according to claim 12, wherein $X_1$ in the general formula (IV) is a carbonyl group, a thiocarbonyl group or =N—R' (wherein R' is an alkyl group which may be further substituted).

15. A silver halide photographic material according to claim 1, wherein the compound of general formula (I) is used in such amounts that, an anti-foggant or development restrainer is in an amount of from $10^{-8}$ to $10^{-1}$ mole per mole of silver; a developing agent is in an amount of from $10^{-2}$ to 10 moles per mole of silver; a pyrazolidone auxiliary developing agent is in an amount of from $10^{-4}$ to 10 moles per mole of silver; a development promoter or a nucleating agent is in an amount of from $10^{-2}$ to $10^{-6}$ mole per mole of silver; a solvent for silver halide is in an amount of from 10-3 to 10 moles per mole of silver; and a dye or a colorant for color diffusion and transfer photography is in an amount of from $10^{-3}$ to 1 mole per mole of silver.

16. A silver halide photographic material according to claim 3, wherein $X_{33}$ in formula (T-6) is a heterocyclic group selected from the group consisting of pyrrole, pyrazole, imidazole, triazole, furan, oxazole, thiophene, thiazole, pyridine, pyridazine, pyrimidine, pyrazine, azepin, oxepin, indole, benzofuran, and quinoline.

17. A silver halide composition according to claim 3, wherein $X_{35}$ in formula (T-7) is a heterocyclic group selected from the group consisting of pyrrole, imidazole, thiazole, furan, oxazole, oxodiazole, thiophene, triazole, thiadiazole, pyridine, pyridazine, pyrimidine, pyrazine, azepin, oxepin, and isoquinoline.

18. A silver halide composition according to claim 3, wherein $X_{40}$ in formula (T-8) is a heterocyclic group selected from the group consisting of pyrrolidine, piperidine, and benzotriazole.

19. A silver halide composition according to claim 3, wherein $X_{31}$, $X_{32}$, $R_{31}$ and $R_{37}$ in formulae (T-1) to (T-9) contain 1 to 20 carbon atoms.

20. A silver halide photographic material according to claim 4, wherein Z is a member selected from the group consisting of alkylene, cycloalkylene, alkenylene, arylene, aralkylene, oxyalkylene, thioalkylene, aminoalkylene, and heterocyclene.

21. A silver halide material according to claim 8, wherein the ring formed by bonding $R_4$ and $R_5$ is a benzene ring.

22. A silver halide photographic material according to claim 3, wherein T in general formula (I) is selected from the compound represented by the following general formula:

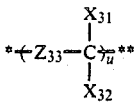

wherein $X_{31}$ and $X_{32}$ denote the same meanings as those defined for formula (T-1), $Z_{33}$ denotes the same meaning as that for formula (T-4) and u denotes the same meaning as that for formula (T-3).

23. A silver halide photographic material according to claim 22, wherein u is 1 or 2.

* * * * *